US007525498B2

(12) United States Patent
Quan et al.

(10) Patent No.: US 7,525,498 B2
(45) Date of Patent: Apr. 28, 2009

(54) ANTENNA ARRAY

(75) Inventors: Clifton Quan, Arcadia, CA (US); Mark S. Hauhe, Hermosa Beach, CA (US)

(73) Assignee: Raytheon Company, Waltham, MA (US)

( * ) Notice: Subject to any disclaimer, the term of this patent is extended or adjusted under 35 U.S.C. 154(b) by 273 days.

(21) Appl. No.: 11/545,841

(22) Filed: Oct. 11, 2006

(65) Prior Publication Data

US 2008/0088519 A1 Apr. 17, 2008

(51) Int. Cl.
*H01Q 13/10* (2006.01)

(52) U.S. Cl. ..... 343/770; 343/700 MS; 343/853; 361/701

(58) Field of Classification Search ..... 343/767, 343/770, 853, 700 MS; 361/699, 700, 701
See application file for complete search history.

(56) References Cited

U.S. PATENT DOCUMENTS 4,990,926 A 2/1991 Otsuka et al.
5,166,864 A * 11/1992 Chitwood et al. ..... 361/720
5,315,480 A * 5/1994 Samarov et al. ..... 361/705
5,403,973 A * 4/1995 Santilli et al. ..... 174/15.1
5,631,446 A 5/1997 Quan
5,829,512 A * 11/1998 August ..... 165/46
7,057,563 B2 6/2006 Cox et al.
2005/0264448 A1 12/2005 Cox et al.
2007/0153481 A1 * 7/2007 Touzov ..... 361/701

FOREIGN PATENT DOCUMENTS

GB 2 397 697 A 7/2004
WO WO 02/19469 A 3/2002

OTHER PUBLICATIONS

PCT International Search Report and Written Opinion of ISA, mailed Mar. 6, 2008, Int'l App No. PCT/US2007/021439.

* cited by examiner

*Primary Examiner*—Tho G Phan
(74) *Attorney, Agent, or Firm*—Leonard A. Alkov

(57) ABSTRACT

An antenna array includes a folded thin flexible circuit board with a thin dielectric layer and a conductor layer pattern formed on a first surface of the dielectric layer. The circuit board may be folded in a plurality of folds to form a pleated structure. An array of radiator structures is formed on the first surface, A conductor trace pattern is formed on the folded circuit board. A plurality of active RF circuit devices is attached to the folded circuit board in signal communication with the conductor trace pattern.

22 Claims, 10 Drawing Sheets

FIG. 9
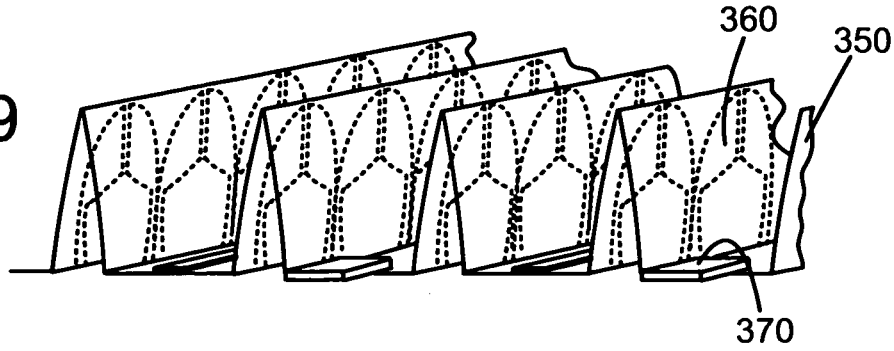
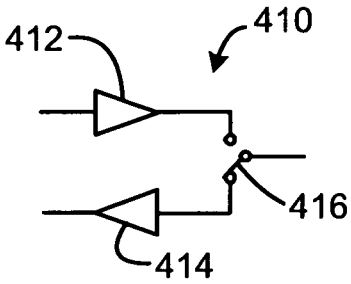
FIG. 10B
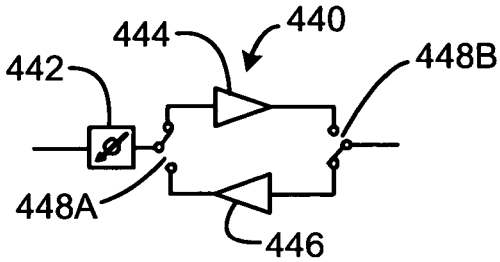
FIG. 10C
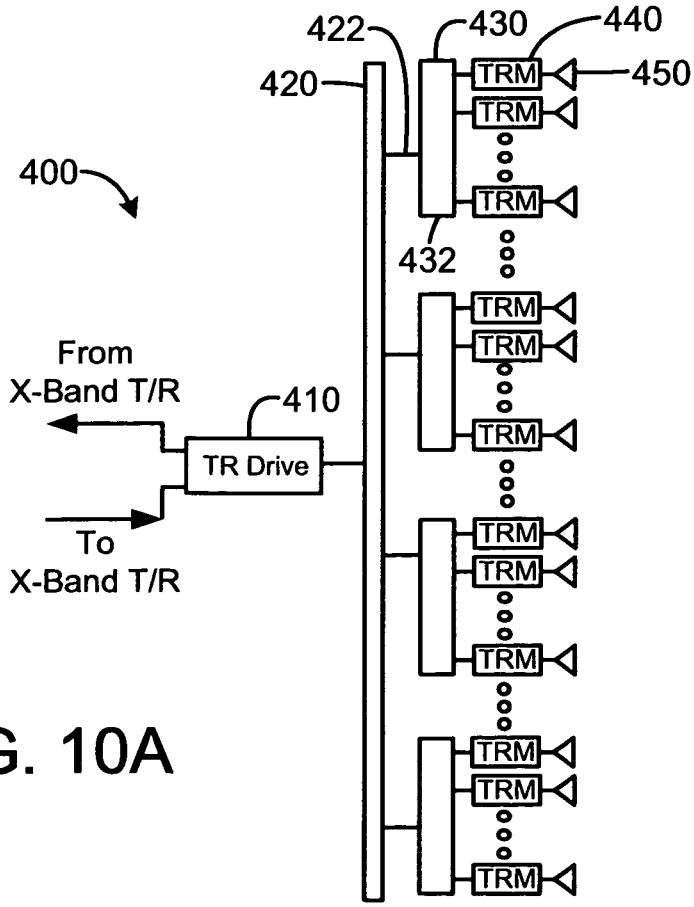
FIG. 10A

ANTENNA ARRAY

BACKGROUND

Next generation large area multifunction active arrays for such exemplary applications as space and airborne based antennas for radar and communication systems, including platforms such as micro-satellites and stratospheric airships, may be lighter weight, lower cost and more conformal than what can be achieved with current active array architecture and multilayer active panel array development.

SUMMARY OF THE DISCLOSURE

An antenna array includes a folded thin flexible circuit board with a thin dielectric layer and a conductor layer pattern formed on a first surface of the dielectric layer. The circuit board may be folded in a plurality of folds to form a pleated structure. An array of radiator structures is formed on the first surface. A conductor trace pattern is formed on the folded circuit board. A plurality of active RF circuit devices is attached to the folded circuit board in signal communication with the conductor trace pattern.

BRIEF DESCRIPTION OF THE DRAWINGS

FIG. 9 is an isometric view of an exemplary embodiment of a folded flexible circuit board employing flared dipole radiators.

FIGS. 10A-10C are schematic block diagrams illustrating features of an exemplary embodiment of an active array subpanel RF circuit.

DETAILED DESCRIPTION

Figure 1:
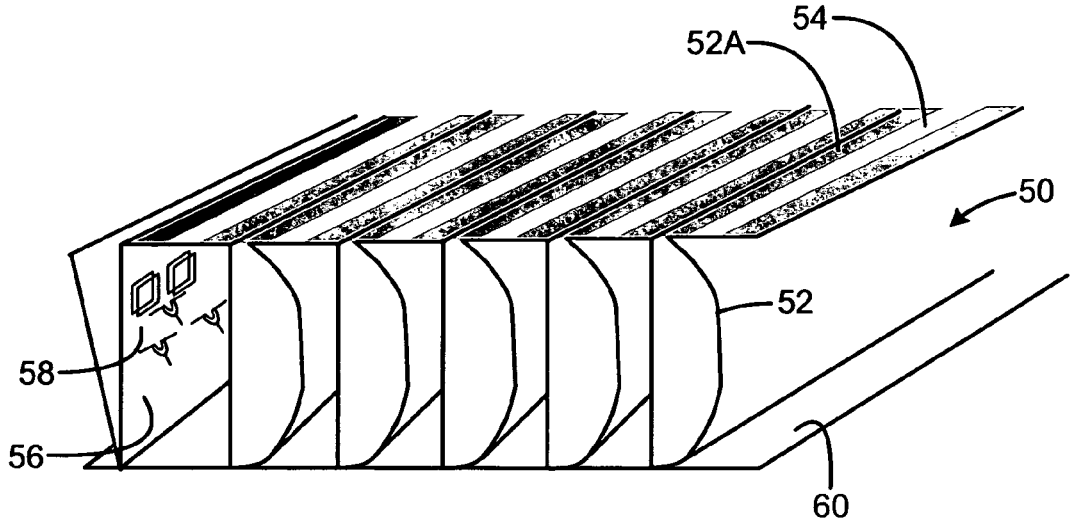
FIG. 1 is an isometric view illustrating an array architecture employing a subarray formed by a folded continuous roll or sheet of a flexible circuit board.

In the following detailed description and in the several figures of the drawing, like elements are identified with like reference numerals. The figures may not be to scale, and relative feature sizes may be exaggerated for illustrative purposes.

An exemplary embodiment of an array antenna architecture may employ radiators, e.g. long slot radiators, formed by folding a thin conductor cladded RF flexible circuit laminate sheet, resulting in a pleated, origami-like appearance, which may sometimes be referred to as an "origami" assembly or origami panel array. The control signals, DC power and RF feed circuit traces may be formed or deposited on this single core laminate sheet together with T/R (transmit/receive) MMICs (monolithic microwave integrated circuits). In an exemplary embodiment, the integrated flexible circuit radiator laminate sheet may be joined to a second layer of flexible circuit laminate containing a second feed layer, e.g., in a non-limiting example, an air stripline feed. In an exemplary embodiment, vertical interconnects are not employed within the folded flexible circuit radiator laminate sheet, significantly reducing the production cost of the array. A non-limiting exemplary embodiment of an array may be about 1 cm thick with a weight of 1.2 kg per square meter. The shape of the flexible circuit may be selected to create the radiator within the fold and on the opposite side of the manifold circuitry, so that the two are shielded from each other. This construction may be fabricated as a single aperture or broken up into subarray panels.

An exemplary non-limiting embodiment of an array antenna integrates the radiator, an RF level one feed network, control signals, and DC power manifold with a single layer of flexible circuit board. In an exemplary embodiment, the assembly may be fabricated without a single conductive via through the layer. FIG. 1 is an isometric view of an exemplary embodiment illustrating an array 50. The array is fabricated using origami-like folding of the flexible circuit board 52 to effectively increase the area to route all the RF, signal, and power lines onto a single layer, without increasing the array lattice area or using any vias within the RF flexible circuit board.

In the exemplary embodiment of FIG. 1, the flexible circuit board 52 is fabricated of a flexible dielectric layer having a layer of conductive material, e.g. aluminum or copper formed on the outer surface. The flexible dielectric layer may be, for example, polyimide, polyethylene, liquid crystal polymer (LCP), Teflon® based substrates, or any organic substrate material of thickness from 5 micro-inches to 5000 micro-inches. The flexible dielectric layer may be, in exemplary embodiments, either in sheet format of up to 36 inches by 36 inches or in roll format several feet wide by 1000's of feet long. These dimensions are non-limiting, and merely given as examples. In an exemplary embodiment, the conductive layer may be selectively removed in elongated areas 54 which are parallel to the folds to form long slot radiators which are positioned at the top of each fold of the origami array 50. Positioned on the opposite surface 56 of the flexible circuit board 52 are RF circuitry, signal lines, and power lines, generally depicted by reference 58 in FIG. 1, for the array. A second circuit board 60 may be attached to the folded circuit board 52 to provide additional circuitry, e.g. for a second level feed network, e.g. a row feed network, in an exemplary embodiment. The board 60 may be flexible or rigid, and may be adhesively attached in an exemplary embodiment.

Figure 2:
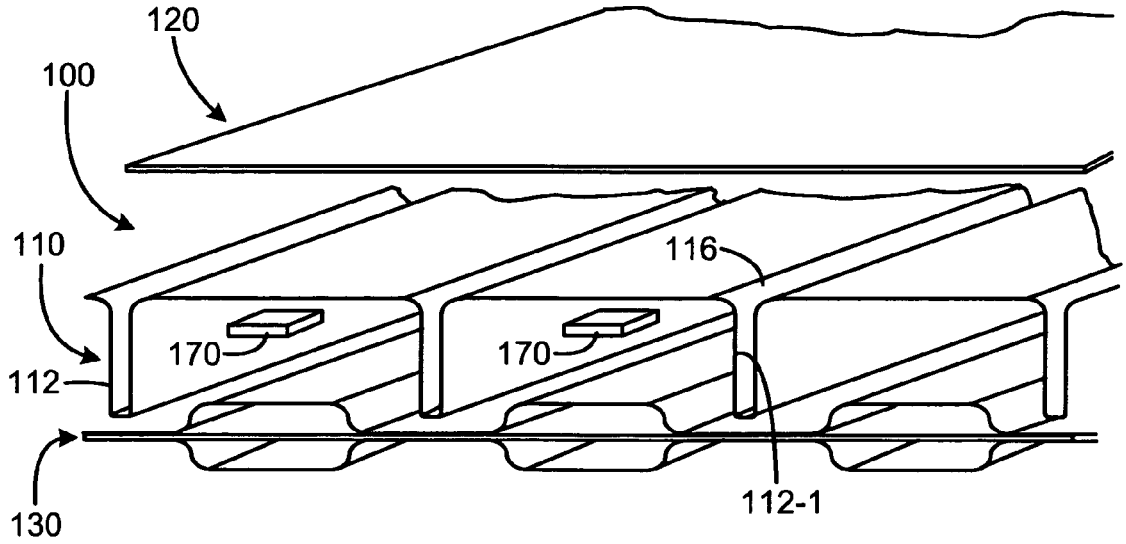
FIG. 2 is an isometric exploded view of elements of an exemplary embodiment of a lightweight array panel.

In an exemplary, non-limiting embodiment, the shape of the origami folds within the RF flexible circuit, e.g. as shown in the exemplary embodiment of FIG. 2, may be that of a cavity backed long slot radiator. This results in having the radiating aperture and the distribution manifolds shielded from each other. TR module chips and capacitors may be mounted onto the three-dimensional (3-D) folded RF flexible circuit using methods such as, by way of non-limiting examples, epoxy or solder attachment of integrated circuits or packaged surface mount components, electrically connected by wired bond or flip chip attachment. The 3-D folding of the RF flexible circuit may enable the incorporation of additional physical features such as enhanced structure support, conformality to two-dimensional (2-D) and 3-D surfaces, and allowance of physical expansion and contraction due to stresses applied to the array during deployment or operation. The integration of functionality for the RF, control and power distribution may eliminate the need for several layers of circuit boards, adhesive bonding films and hundreds of thousands of plated via as typically employed in a multilayer PCB. The result is a simplified construction of an active array panel that is light in weight.

Figure 2A:
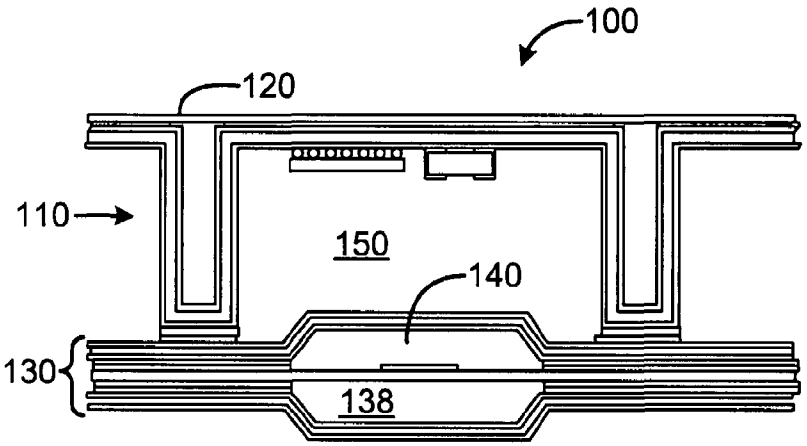
FIG. 2A is an end view of the array of FIG. 2.

Additional array functional and mechanical features may be incorporated onto the basic origami array or subarray by integrating additional layers of 3-D folded RF flexible circuit boards or simple flat sheets of RF flexible circuit boards. FIGS. 2-2C illustrate features of an exemplary embodiment of an array 100, comprising an origami subarray 110. The subarray 110 includes a thin laminate sheet 112, which may include a flexible dielectric substrate 112B, with a conductive layer pattern 112A formed on a first, top surface of the dielectric sheet and a conductor pattern 112C formed on a second, lower surface of the dielectric substrate. The sheet 112 has a plurality of parallel folds or pleats 112-1 formed therein. The folds 112-1 define cavities 114.

Suitable techniques for forming the sheet into the origami folded structure may include as exemplary, non-limiting examples, molding using hard die tooling as in a waffle iron or through continuous folding across a mandrill or straight edge blade, sometimes with localized application of heat. Control of the shape may be dependant on the base material of the sheet. For example, in the case of LCP, the shape may be accomplished via cross linking polymers at elevated temperature in a molding process. Other materials may be "creased" to ensure proper shape outline and then through an additional polymer layer attachment, held in place much like a Venetian blind or an open cell structure as in a honeycomb.

In an exemplary embodiment, in which the radiator structures are cavity backed long slot radiators, the conductive layer pattern 112B may be a continuous ground plane layer with a set of relieved areas or windows formed therein for allowing excitation by a set of probes on the opposite side of the dielectric layer.

A single layer of RF flexible circuit board may be attached to the top of the origami subarray to form a radome 120. Exemplary radome materials may vary, from thin 0.001 inch thick polyimide to several inch thick sandwich materials made up of various polymers or esters. The radome materials may typically be chosen to reduce RF loss or to help match the radiating aperture to free space. Solar reflectors are typically polymer films such as, for example, polyesters or acrylate films, either single layered or multilayer.

The array 100 may further include, in an exemplary non-limiting embodiment, a second level manifold and face sheet structure 130, fabricated in an exemplary embodiment as a combination of three layers 132, 134, 136 (FIG. 2B) of 3-D folded/formed flexible circuit sheets to form a second level RF feed network as well as provide control signal and DC power lines. The second level structure 130 may be assembled to the origami subarray 110, and may be used in an exemplary embodiment to serve several origami subarrays in combination to form a single large area aperture assembly. For some applications, the structure 130 may not be included.

Figure 3:
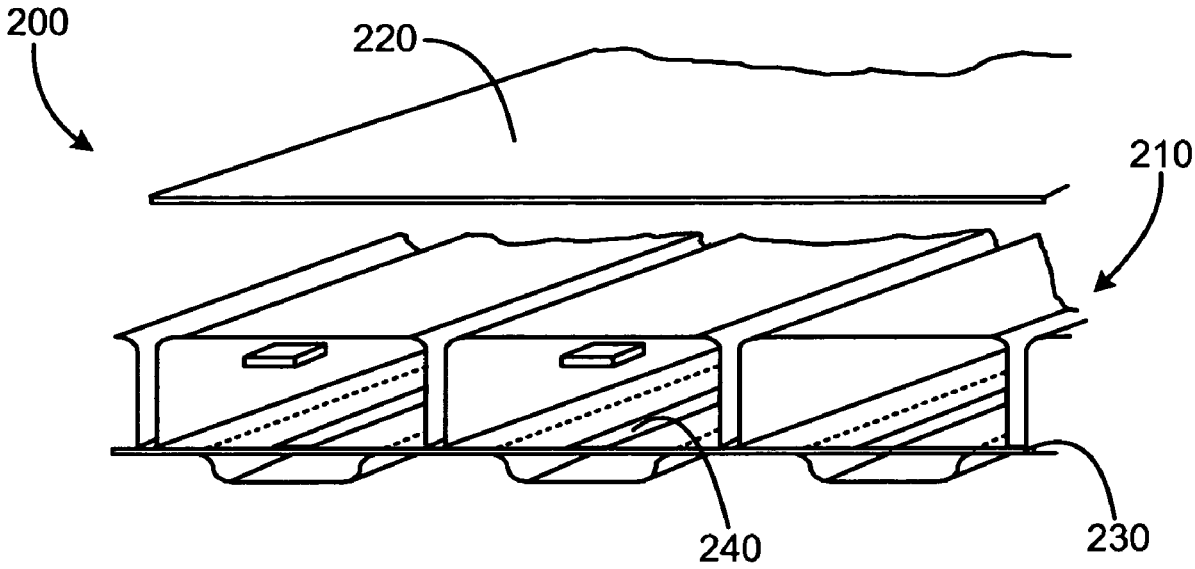
FIG. 3 is an exploded view of a portion of another exemplary embodiment of an array including a subarray formed from a continuous flexible circuit board.

In an exemplary embodiment, the second level structure 130 may utilize low loss airstripline transmission lines 140 to distribute RF signals, e.g. to the various origami subarrays. The RF flexible circuit boards 132, 136 are shaped to form metalized air channels 138 around the air stripline circuit traces. Suspended microstrip transmission lines can also be used to realize a second level RF feed, as depicted in FIG. 3. The assembly of the origami subarray 110 and the second level structure 130 forms shielded cavities/channels 150 (FIG. 2A) to reduce electromagnetic interference (EMI).

Figure 2B:
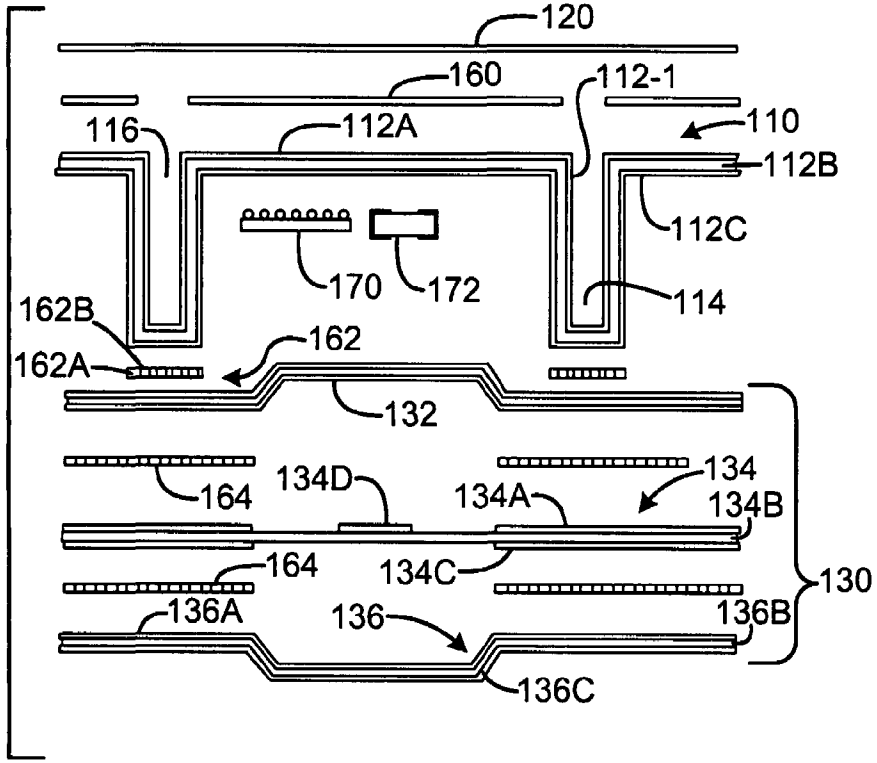
FIG. 2B is an exploded diagrammatic end view of the array portion of FIG. 2A.
Figure 2C:
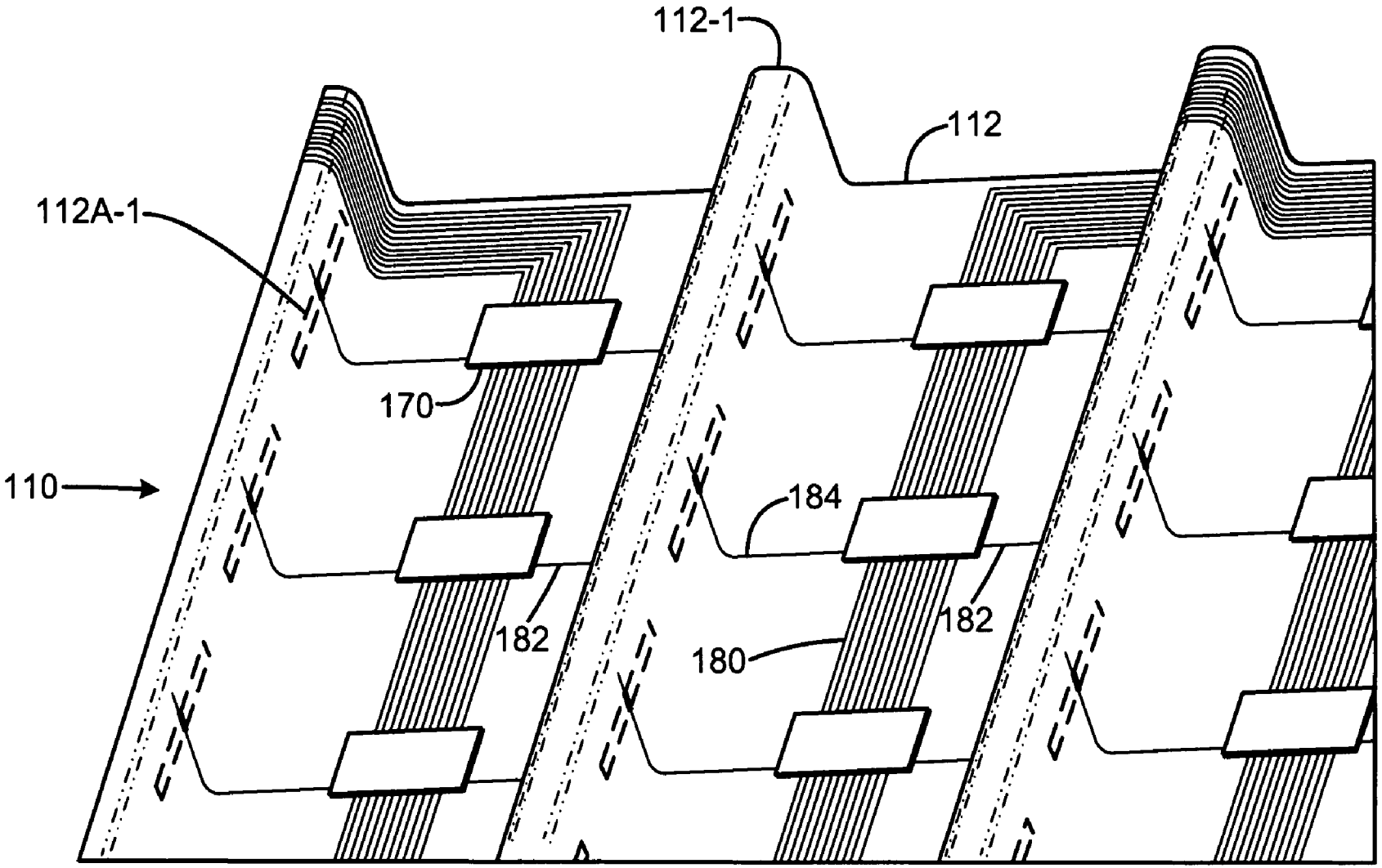
FIG. 2C is a diagrammatic isometric view, illustrating features of an exemplary embodiment of the subarray structure of FIG. 2.

As illustrated in the exploded view of FIG. 2B, in an exemplary embodiment, attachment of radome 120 to the subarray 110, and of the subarray 110 to the second level structure 130 may be accomplished by adhesives. A structural adhesive layer 160 may be employed to attach the radome 120 to the origami subarray 110.

The origami subarray 110 may be fabricated with a flexible circuit board including a dielectric layer 110B, a groundplane layer 110A formed on an upper surface of the dielectric layer, e.g. an aluminum layer. The folding of the structure 110 creates X band long slot radiators 116 in the "creases" or folds 112-1 of the folded circuit board. The undersurface of the dielectric layer 110B has formed thereon a conductor pattern defining an RF, e.g. X band, level one feed network with signal and power line manifolds.

A structural and conductive adhesive layer 162 may be used to bond the second level feed structure 130 to the first level feed network fabricated on the origami subarray 110. The structural adhesive may be in a form of a "prepreg" layer 162A and may have holes cut in it for the placement of conductive adhesive portions 162B, to make selective electrical contacts between control signal and power lines in the structure 110 and structure 130. "Prepreg" (preimpregnation) refers to a resin based material sometimes with a mat or woven fabric used to combine layers of polymer into a monolithic structure. The conductive adhesive may be screened on after placement of the structural prepreg layer. When cured, i.e. processed by thermally accelerating the hardening of adhesive epoxies, the conductive adhesive may provide the path for both the signal and power lines. An RF connection may be obtained by capacitive coupling between two pads placed on the level one and level two feeds.

FIG. 2C illustrates a fragment of an exemplary embodiment of the subarray structure 110, showing the underside of the flexible circuit board assembly 112 having fabricated thereon conductor pattern 180 for conducting power and control signals to active devices 170 mounted on the substrate 112. The active devices may include T/R module MMIC chips, for example. The underside of the substrate also has fabricated thereon a conductor pattern 182 which forms a first level RF feed network interconnecting the active devices 170 with a second level RF feed network formed on the second level structure 130. Also fabricated on the substrate are conductor traces 184 connected to the active devices 170 and include portions which act as radiator structure probes. The conductor traces 184 pass over slots or windows 112A-1 formed in the conductive layer 112B (FIG. 2B) on the opposite surface of the structure 110. These probes 184 excite the cavities of the long slot radiators.

FIG. 3 is an isometric view of an alternate exemplary embodiment of an array architecture 200, which is similar to the array 100 of FIG. 2, except that the second level feed structure 230 employs a suspended microstrip transmission line structure 240 to realize the second level RF feed structure 230.

FIGS. 4-7 illustrate an exemplary embodiment of an interconnection of the control signal and DC power lines to transmit/receive (T/R) chips 170 mounted on the origami subarray 110. In this embodiment, the control signal and DC power lines are run serially to the TR module chips 170 along the 3-D origami subarray panel substrate 112. The signal and power lines and TR chip I/O's generally comprising manifold 180 may be orthogonal to the RF lines and I/O's of the feed network 180 that run from the first level RF feed and radiator transition to avoid cross-overs and via interconnects within the RF flexible circuit board 112. Microstrip transmission line may be used for the first level RF feed network 180, as it can be routed along the folded RF flexible circuit board 112. Because the manifold circuitry is placed along the side of the long slot radiators, there is no increase in the thickness of the antenna; for X-band the thickness of the origami panel in an exemplary non-limiting embodiment may be a little over a centimeter, exclusive of side electronics. The radiator transition may incorporate a microstrip transmission line 182 running from the TR chips 170 along the RF flexible circuit board coupling to either a slot 112A-1 located along the side of the radiator cavity or a probe 184 the runs across the top of the cavity.

Figure 4:
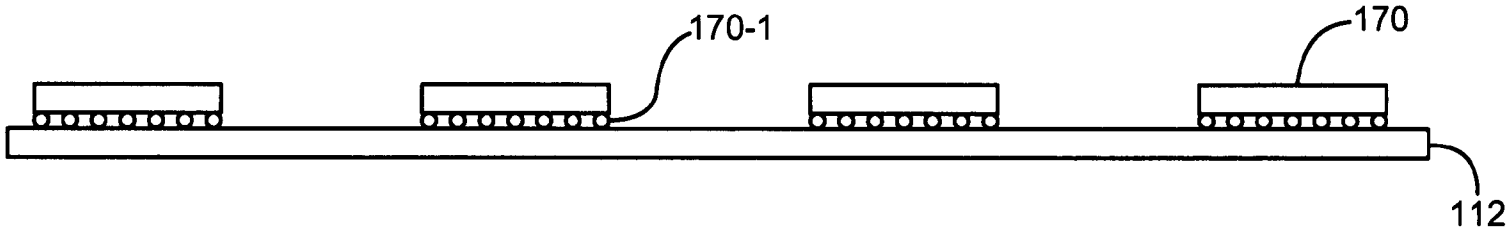
FIG. 4 is a diagrammatic side view illustrating an exemplary mounting arrangement for T/R module chips on a panel array assembly.

FIG. 4 diagrammatically depicts an exemplary embodiment of a technique for attaching RF circuit devices 170 to an array substrate 112. In this example, the devices 170 may be MMIC chips, mounted to the substrate 112 by conductor pads 170-1. These MMIC chips may provide T/R module functions, e.g. for an X-band array frequency regime.

Figure 5:
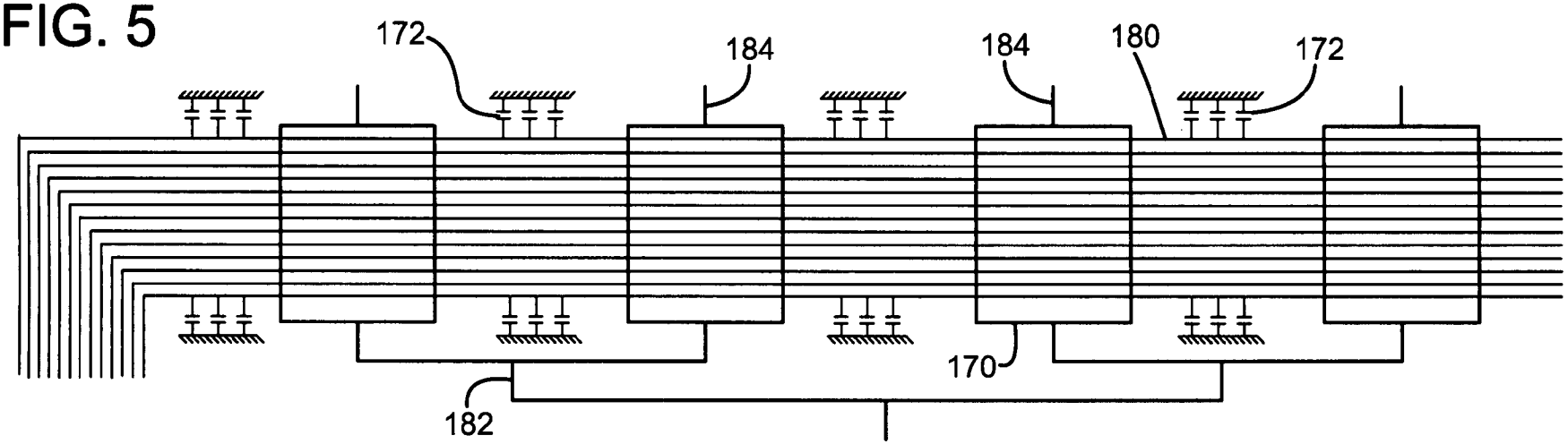
FIG. 5 is a diagrammatic schematic diagram illustrating an exemplary control signal and DC power manifold arrangement for a portion of an array assembly.

FIG. 5 is a top view depiction of an exemplary embodiment of a portion of the circuitry formed on the underside of the substrate 112 along one fold or pleat of the origami substrate structure. A conductor trace pattern defines the control signal and power manifold 180 which series connects the active devices 170 attached to the substrate 112. An RF level one feed network depicted as 182 provides RF signals to the active devices 180, with RF probe conductors 184 connected to the active devices 180.

Figure 6:
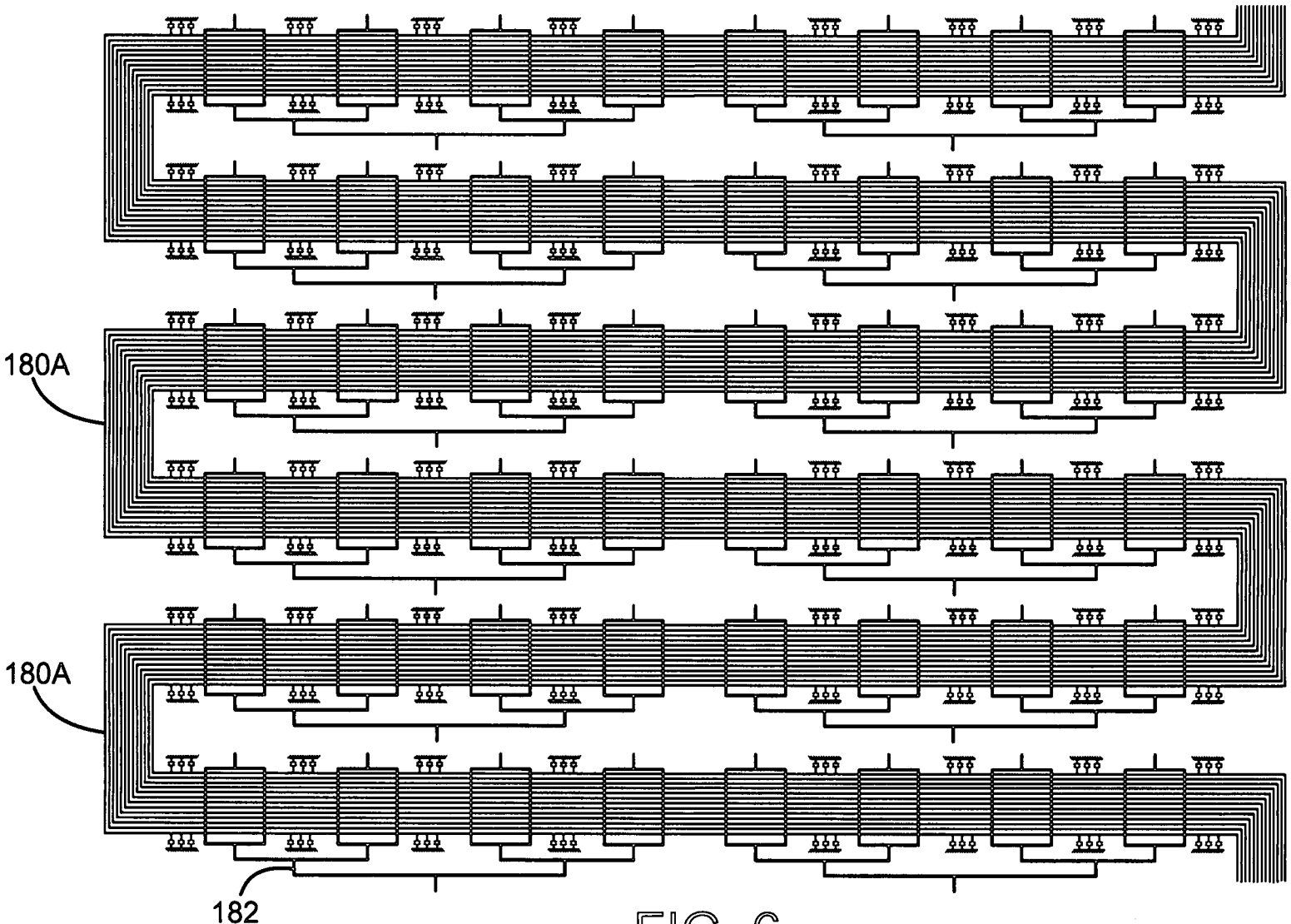
FIG. 6 is a schematic diagram of an exemplary embodiment of power and control signal lines for the T/R modules of a panel array assembly.

FIG. 6 is a top view depiction of an exemplary embodiment of a larger portion of the circuitry depicted in FIG. 5, for several adjacent folds or pleats in the substrate structure 110. The series connection of the control signal and power manifold may be extended from one column area between two adjacent folds to the next column area by passing the transverse conductor pattern portion 180A under one fold to connect to the parallel conductor pattern portions in the adjacent column areas. The level one RF feed network 182 is also depicted.

Figure 7:
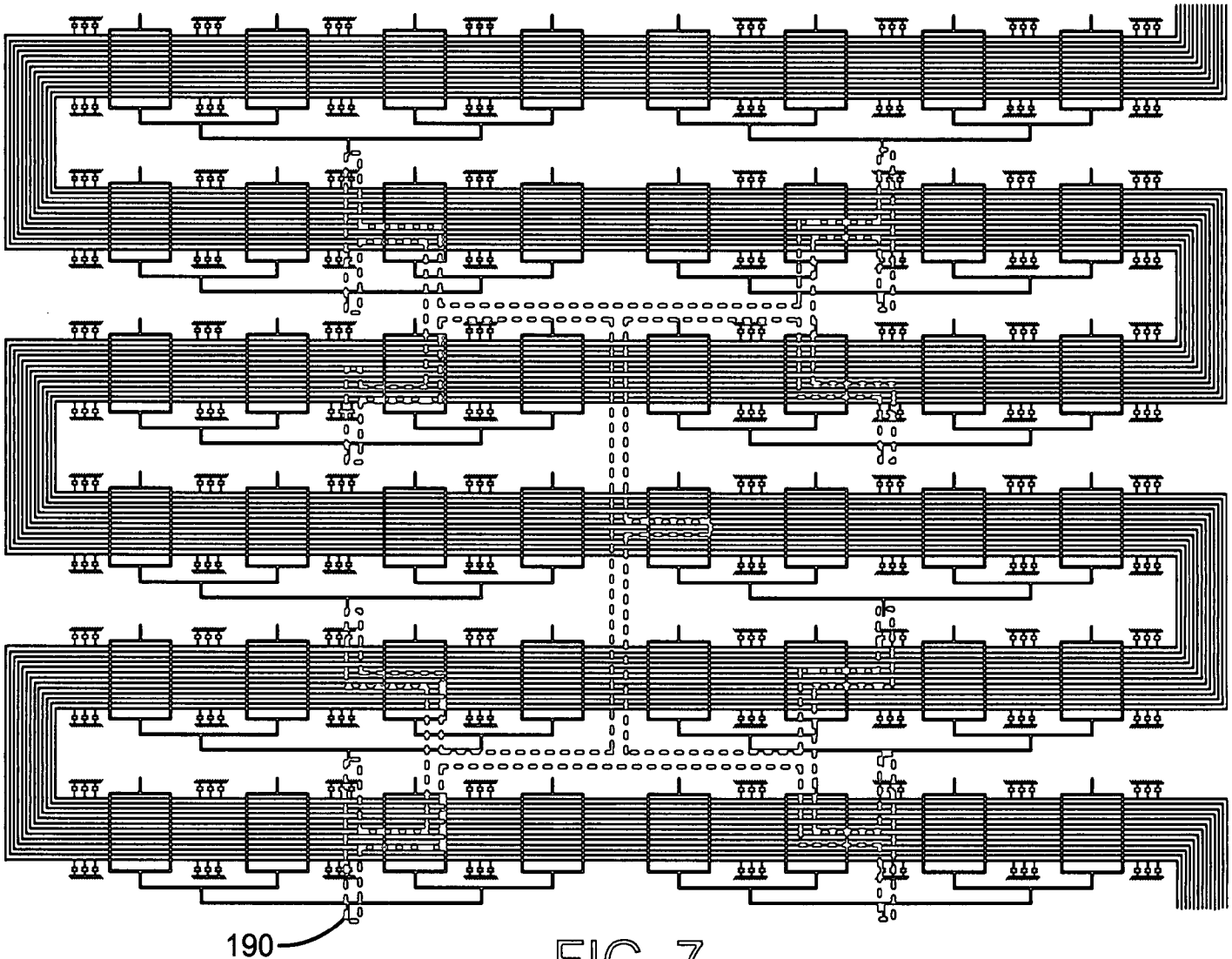
FIG. 7 is a schematic diagram similar to FIG. 6, showing an exemplary embodiment of a second level RF feed network.

FIG. 7 is a view similar to that of FIG. 6, with an exemplary embodiment of a second level RF feed network 190 depicted in dashed lines. The network 190 is fabricated on or in the second level structure 130, including the transmission line 140.

Figure 8:
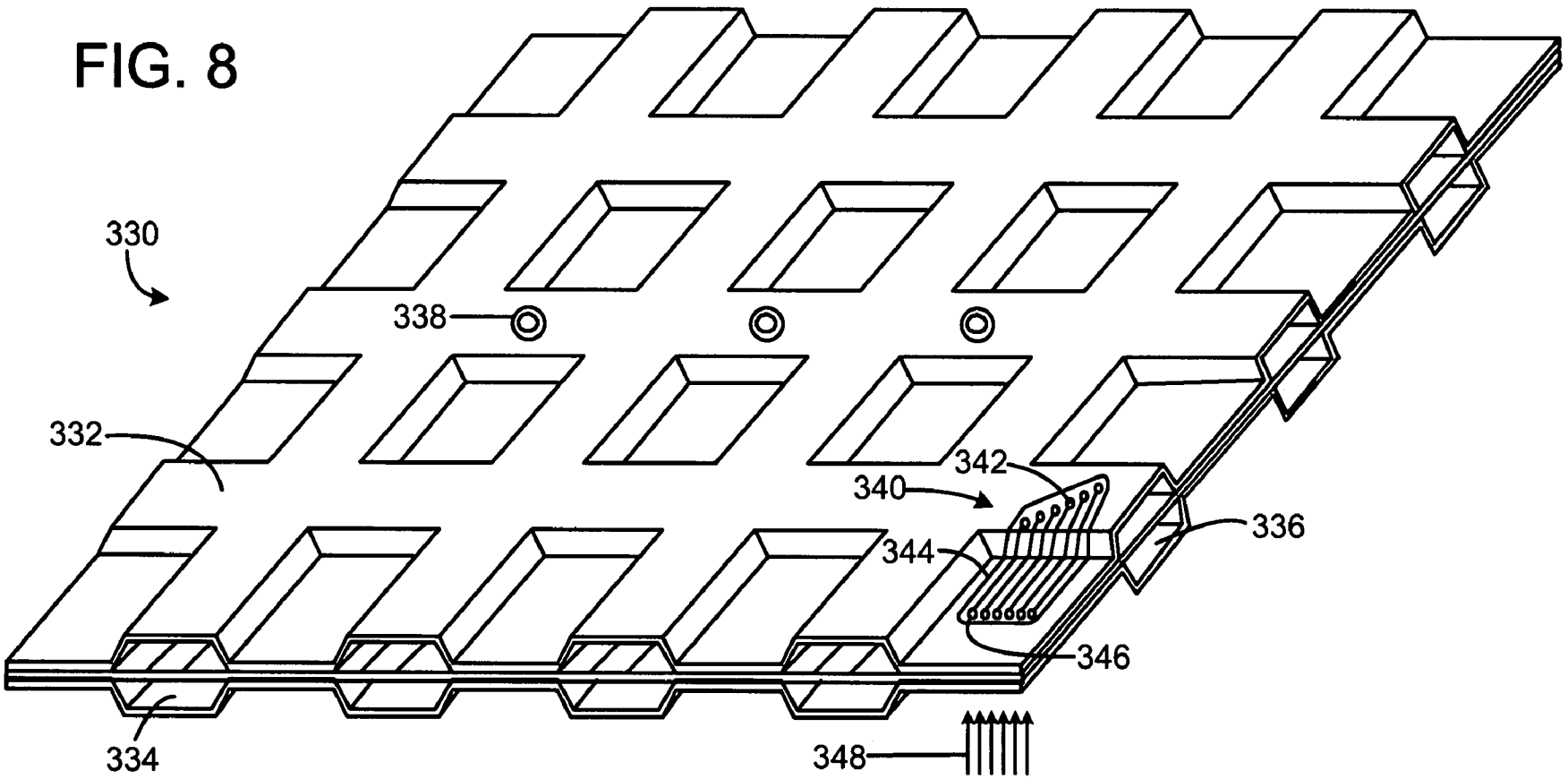
FIG. 8 is a diagrammatic isometric view of an exemplary embodiment of a base structure for an exemplary panel array assembly.

An exemplary alternative embodiment of a second level structure is depicted in FIG. 8, as structure 330. An origami panel structure such as panel 110 may be attached to the structure 330 in a manner similar to that depicted in FIG. 2, except that the folds of the panel 110 are attached to the structure 330 at the raised areas above the suspended stripline channels. The structure 330 has a "waffle" pattern facilitating fabrication of the stripline channels 334, 336 in two, transverse directions. Conductive vias 338 may be formed in the top layer of the structure 330 to provide electrical interconnection from the top surface to another layer of the structure. The structure 330 illustrates a fragment of an exemplary conductor pattern 340 which may interconnect to the conductor pattern fabricated on the matching origami subarray structure. The conductor pattern may include, for example, conductor pads 342 which electrically connect to pads in the conductor pattern of the origami subarray through z-axis conductive adhesive, for example, when the structure 330 is assembled to the subarray. The conductor pattern 340 further includes conductor lines 348 which run to a set of vias 346. Electrical connections may be made to the conductor pattern on opposite ends of the vias 346 on the underside of the structure 330. The conductor pattern may be extended or replicated as needed over areas of the structure 330.

Other types of radiators may be folded within the origami panel subarray beside the long slot radiators. FIG. 9 depicts flared dipole radiators 360 incorporated into a folded RF flexible circuit board assembly 350. T/R module chips 370 are mounted on flat surfaces of the circuit board assembly 350.

An exemplary RF architecture for an exemplary embodiment of an origami active sub-panel array is illustrated in FIGS. 10A-10C. FIG. 10A depicts an exemplary block diagram for an RF active array system 400. The system includes a transmit/receive (T/R) drive circuit 410, depicted in further detail in FIG. 10B, which is connected to an exemplary second level feed network 420 for the sub-panel array 400. The T/R drive circuit 410 receives an input drive signal from an RF exciter such as an X-band exciter, and routes received signals from the T/R modules to a receiver circuit such as an X-band receiver. The feed network 420 has I/O ports 422 connected respectively to I/O ports of the first level RF feed network 430. The first level RF feed network has I/O ports 432 which are connected in turn to the transmit/receive (T/R) module chips 440 mounted on the origami panel circuit board. The radiators 450 are connected to the T/R module chips.

FIG. 10B illustrates a schematic functional block diagram of an exemplary embodiment of a T/R drive circuit 410, which includes a power amplifier 412 for amplifying exciter signals, a low noise amplifier 414 for amplifying received signals, and a switch 416 for selecting transmit or receive channels.

FIG. 10C illustrates a schematic functional block diagram of an exemplary embodiment of a T/R module chip 440, which includes a power amplifier 446 for amplifying transmit signals from the T/R drive circuit 410, a low noise amplifier 446 for amplifying received signals from the radiator 450, and switches 448A, 448B for selecting either the transmit channel or the receive channel. The chip 440 also includes a variable phase shifter 442.

Figure 11:
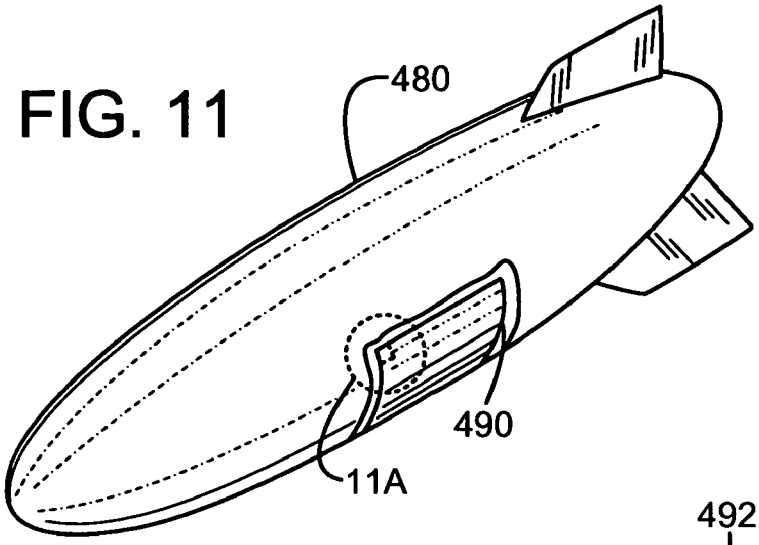
FIG. 11 is an isometric view of an airship employing an exemplary embodiment of a panel array assembly.
Figure 11A:
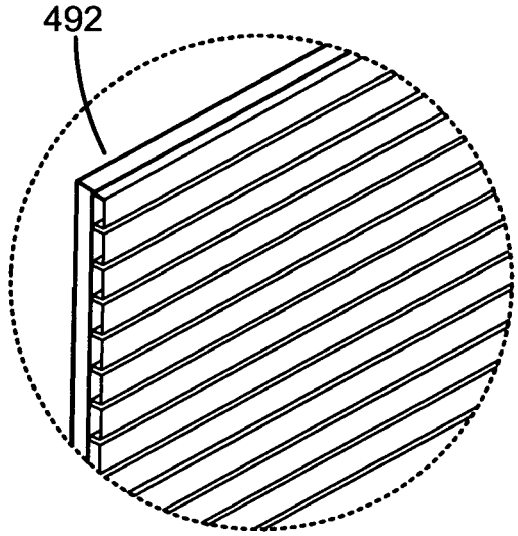
FIG. 11A is an isometric view of a portion of the panel array assembly within circle 11A of FIG. 11.

One exemplary application for an origami array antenna is the construction of a thin light weight active array antenna 490 mounted on the skin of an airship 480 as shown in FIGS. 11 and 11A. In this example the antenna may incorporate hundred of individual origami active panels 492 mounted onto the skin.

Connection of the power, signal and RF lines from the airship to the level two feed on the panels may be accomplished by use of low profile connectors. A straight, surface mount GPPO-style RF connector is both lightweight and low loss. A right angle button style fitting on the mating connector may provide a light weight yet easily routable cable solution. For the power and signal lines a standard low profile, light weight, surface mount microD connector may be used. The microD connector can be oriented as either straight or right angle to best facilitate cable routing.

Thin RF flexible circuit technologies may be employed in the fabrication of thin ultra-lightweight flexible active panel array antennas. Applying 3-D circuitry onto a folded/formed RF flexible layer may be a key enabler to integrations of both electrical and mechanical functions. This may result in a significant reduction in the number of dielectric, conductor, and adhesive layers. Also the number of interconnects may be almost eliminated and in an exemplary embodiment may be principally located in the second level RF feed.

Although the foregoing has been a description and illustration of specific embodiments of the subject matter, various modifications and changes thereto can be made by persons skilled in the art without departing from the scope and spirit of the invention as defined by the following claims.

What is claimed is:

1. An antenna array, comprising:

a folded thin flexible circuit board comprising a thin dielectric layer and a conductor layer pattern formed on a first surface of the dielectric layer, the circuit board folded in a plurality of folds to form a pleated structure, an array of radiator structures on said first surface, and a conductor trace pattern formed on the folded circuit board to carry control signals, DC power and RF signals; and a plurality of active RF circuit devices mounted on the folded circuit board in signal communication with said conductor trace pattern.

2. The array of claim 1, wherein the folded circuit board includes an RF feed network defined by the first conductor trace pattern.

3. The array of claim 1, wherein the folded circuit board is adapted to form the array of radiators within respective folds and on an opposite side, of the folded circuit board from the conductor trace pattern, so that the array of radiators and the conductor trace pattern are shielded from each other from RF interference.

4. The array of claim 1, wherein the folded circuit board is free of conductor vies passing through the dielectric layer.

5. The array of claim 1, wherein the plurality of active RF circuit devices includes a plurality of transmit/receive (T/R) module circuit devices.

6. The array of claim 1, wherein the array of radiator structures includes an array of flared dipole radiator structures.

7. An antenna array, comprising:

a folded thin flexible circuit board comprising a thin dielectric layer and a conductor layer pattern formed on a first surface of the dielectric layer, the circuit board folded in a plurality of folds to form a pleated structure, an array of radiator structures on said first surface, and a conductor trace pattern formed on the folded circuit board to carry control signals, DC power and RF signals, and wherein the conductor layer pattern includes a ground plane portion, and said array of radiator structures includes an array of long slot radiator structures formed by open slot regions defined in the ground plane portion parallel to said plurality of folds; and a plurality of active RF circuit devices attached to the folded circuit board in signal communication with said conductor trace pattern.

8. An antenna array, comprising:

a folded thin flexible circuit board comprising a thin dielectric layer and a conductor layer pattern formed on a first surface of the dielectric layer, the circuit board folded in a plurality of folds to form a pleated structure, an array of radiator structures on said first surface, and a conductor trace pattern formed on the folded circuit board to carry control signals, DC power and RF signals, and wherein the conductor layer pattern includes a ground plane portion, and said array of radiator structures includes cavity backed long slot radiator structures formed by the plurality of folds; and a plurality of active RF circuit devices attached to the folded circuit board in signal communication with said conductor trace pattern.

9. The array of claim 8, wherein the ground plane portion includes a plurality of windows free of conductor layer, and the conductor trace pattern includes a plurality of RF conductor probes for exciting the cavity backed long slot radiator structures through said windows.

10. An antenna array, comprising:

a folded thin flexible circuit board comprising a thin dielectric layer and a conductor lever pattern formed on a first surface of the dielectric layer, the circuit board folded in a plurality of folds to form a pleated structure, an array of radiators structures on said first surface, and a conductor trace pattern formed on the folded circuit board to carry control signals, DC power and RF signals;

a plurality of active RF circuit devices attached to the folded circuit board in signal communication with said conductor trace pattern; and a circuit board structure attached to said folded thin flexible circuit board at folds of said pleated structure and including a second conductor trace pattern, said attachment of said circuit board structure to said folds of said pleated structure resulting in electrical connection between said conductor trace pattern formed on said folded circuit board and said second conductor trace pattern.

11. An antenna array, comprising:

a thin flexible circuit laminate sheet comprising a thin dielectric layer and a conductor layer pattern formed on a first surface of the dielectric layer, the laminate sheet folded in a plurality of folds to form a pleated structure and an army of radiator structures, and a first conductor trace pattern formed on a second surface of the thin dielectric layer;

a plurality at active RF circuit devices attached to the second surface of the thin dielectric layer in signal communication with said conductor trace pattern; and a thin flexible circuit laminate sheet structure attached to said first circuit laminate sheet at folds of said pleated structure and including a second conductor trace pattern, said attachment of said laminate sheet structure to said folds of said pleated structure resulting in electrical connection between said first conductor trace pattern and said second conductor trace pattern.

12. The array of claim 11, wherein the flexible circuit laminate sheet includes a first RF feed network, and the flexible circuit laminate sheet structure includes a second RF feed network.

13. The array of claim 12 wherein the second RF feed layer includes an air stripline feed circuit.

14. The army of claim 12 wherein the second RF feed layer includes a suspended microstrip feed circuit.

15. The array of claim 11, wherein the flexible circuit laminate sheet is adapted to form the any of radiators within respective folds and on an opposite side of the flexible circuit laminate sheet from the first conductor trace pattern, so that the array of radiators and the first flexible conductor trace pattern are shielded from each other from RF interference.

16. The array of claim 11, wherein the flexible circuit laminate sheet is free of conductor vias passing through the dielectric layer.

17. The array of claim 11, wherein the plurality of active RF circuit devices includes a plurality of transmit/receive (T/R) module circuit devices.

18. The array of claim 11, wherein the array of radiator structures includes an array of long slot radiator structures.

19. The array of claim 18, wherein the long slot radiator structures are cavity backed long slot radiator structures.

20. The array of claim 11, wherein the array of radiator structures includes an array of flared dipole radiator structures.

21. The array of claim 11, further comprising a radome structure attached to said Thin flexible circuit laminate sheet so that said thin flexible circuit laminate sheet is sandwiched between said radome structure and said thin flexible circuit laminate sheet structure.

22. The array of claim 11, wherein said thin flexible circuit laminate sheet structure is adhesively attached to said thin flexible circuit laminate sheet by a structural and conductive adhesive layer which makes electrical contact between first conductor trace pattern and said second conductor trace pattern to connect control signals and DC power between said first conductor trace pattern and said second conductor trace pattern.

* * * * *